United States Patent [19]

Berfield et al.

[11] Patent Number: 4,616,378

[45] Date of Patent: Oct. 14, 1986

[54] MEANS FOR MOUNTING FLOOR PICKUP NOZZLE TO DOLLY FOR VACUUM CLEANER

[75] Inventors: Robert C. Berfield, Jersey Shore; Robert Crevling, Williamsport, both of Pa.

[73] Assignee: Shop-Vac Corporation, Williamsport, Pa.

[21] Appl. No.: 726,612

[22] Filed: Apr. 24, 1985

[51] Int. Cl.[4] ..... A47L 11/30; A47L 7/00

[52] U.S. Cl. ..... 15/353; 15/401

[58] Field of Search ..... 15/320, 353, 401

[56] References Cited

U.S. PATENT DOCUMENTS

| | | | |
|---|---|---|---|
| 2,876,484 | 3/1959 | Wells | 15/401 X |
| 2,914,791 | 12/1959 | Wells | 15/401 X |
| 3,063,082 | 11/1962 | Rosenberg | 15/401 X |

FOREIGN PATENT DOCUMENTS

| | | | |
|---|---|---|---|
| 541142 | 11/1941 | United Kingdom | 15/401 |

*Primary Examiner*—Chris K. Moore

*Attorney, Agent, or Firm*—Ostrolenk, Faber, Gerb & Soffen

[57] ABSTRACT

A mounting means secures a floor nozzle to the front of a wheeled dolly base which supports a vacuum cleaner that is connected to the outlet of the nozzle by a flexible hose. The mounting means includes a plate having struts extending therefrom to opposite ends of the nozzle. A rearward extension of the nozzle, disposed midway between the nozzle ends, is connected directly to the plate by a manually operable height adjusting means. An upwardly offset rearward facing ear on the plate is received by a slot that is centered at the front of the dolly base. Two of the swivel-type wheel units that support the base are each provided with a vertical pivot shaft that extends upwardly into and is frictionally held in a wheel well on the base. Before entering the wheel wells, the pivot shafts pass through apertures in the plate thereby fixing the nozzle against all forces in a horizontal plane.

20 Claims, 7 Drawing Figures

MEANS FOR MOUNTING FLOOR PICKUP NOZZLE TO DOLLY FOR VACUUM CLEANER

BACKGROUND OF THE INVENTION

This invention relates to dolly mounted vacuum cleaners generally of the type illustrated in U.S. Pat. No. 2,989,769, issued June 27, 1967 to F. C. Houser for a Floor Drying Apparatus. More particularly, this invention relates to an elongated floor pickup nozzle and its attachment to the dolly.

So-called wet/dry vacuum cleaners of the type disclosed in U.S. Pat. No. 4,435,877, issued Mar. 13, 1984 to R. C. Berfield for Noise Reducing Means for Vacuum Cleaner, are often provided with relatively large accumulating tanks that are mounted on hand trucks or dollies of the type disclosed in co-pending U.S. patent application Ser. No. 703,088, filed Feb. 19, 1985 by R. C. Berfield for Dolly With Tank Latch, and assigned to the assignee of the instant invention. When vacuum cleaners of this type are used to clean relatively large floor areas, it is desirable that the pickup or nozzle be attached to the dolly that supports the vacuum cleaner. With this type of arrangement, the hose that connects the nozzle to the vacuum cleaner is not subjected to strain that might otherwise be imposed thereon, say if by moving the nozzle a force was applied through the connecting hose to drag the relatively heavy vacuum cleaner.

SUMMARY OF THE INVENTION

To avoid the foregoing condition and to facilitate operation of the vacuum cleaner when a large floor area is to be cleaned, the instant invention provides a floor pickup nozzle and novel means for attaching same to a dolly that supports the vacuum cleaner. This is accomplished by providing a mounting plate having a central upwardly offset ear that extends into a complementary opening at the front of the dolly base. The plate is provided with holes that are aligned with two wheel wells at the front of the dolly base that receive and frictionally hold the vertical swivel shafts of the two swivel-type wheel assemblies. According to the instant invention, these swivel shafts are inserted through the holes in the mounting plate before being received by the wheel wells.

An adjustable securing means extends through the mounting plate and engages a short rearward extension of the nozzle so as to mount the nozzle at a proper height with respect to the ground. Opposite ends of the nozzle are connected to the plate by struts that are pivotally connected to the latter by having upwardly offset flattened ends which are received by complementary slots in the mounting plate.

Accordingly, the primary object of the instant invention is to provide improved mounting means for securing a vacuum cleaner floor nozzle unit to a dolly on which the vacuum cleaner is mounted, especially without the need of tools.

Another object is to provide mounting means of this type that does not require the use of tools for operatively securing a floor nozzle unit to a dolly.

Still another object is to provide mounting means of this type that may readily be assembled with the floor nozzle unit and the dolly.

A further object is to provide mounting means of this type that is operatively secured to the base of the dolly by utilizing existing swivel-type wheel units of the dolly.

A still further object is to provide a mounting means of this type which provides means for adjusting the vertical position of the nozzle unit.

BRIEF DESCRIPTION OF THE DRAWINGS

These objects as well as other objects of this invention shall become readily apparent after reading the following description of the accompanying drawings in which.

DETAILED DESCRIPTION OF THE PREFERRED EMBODIMENT

Figures 1, 2:
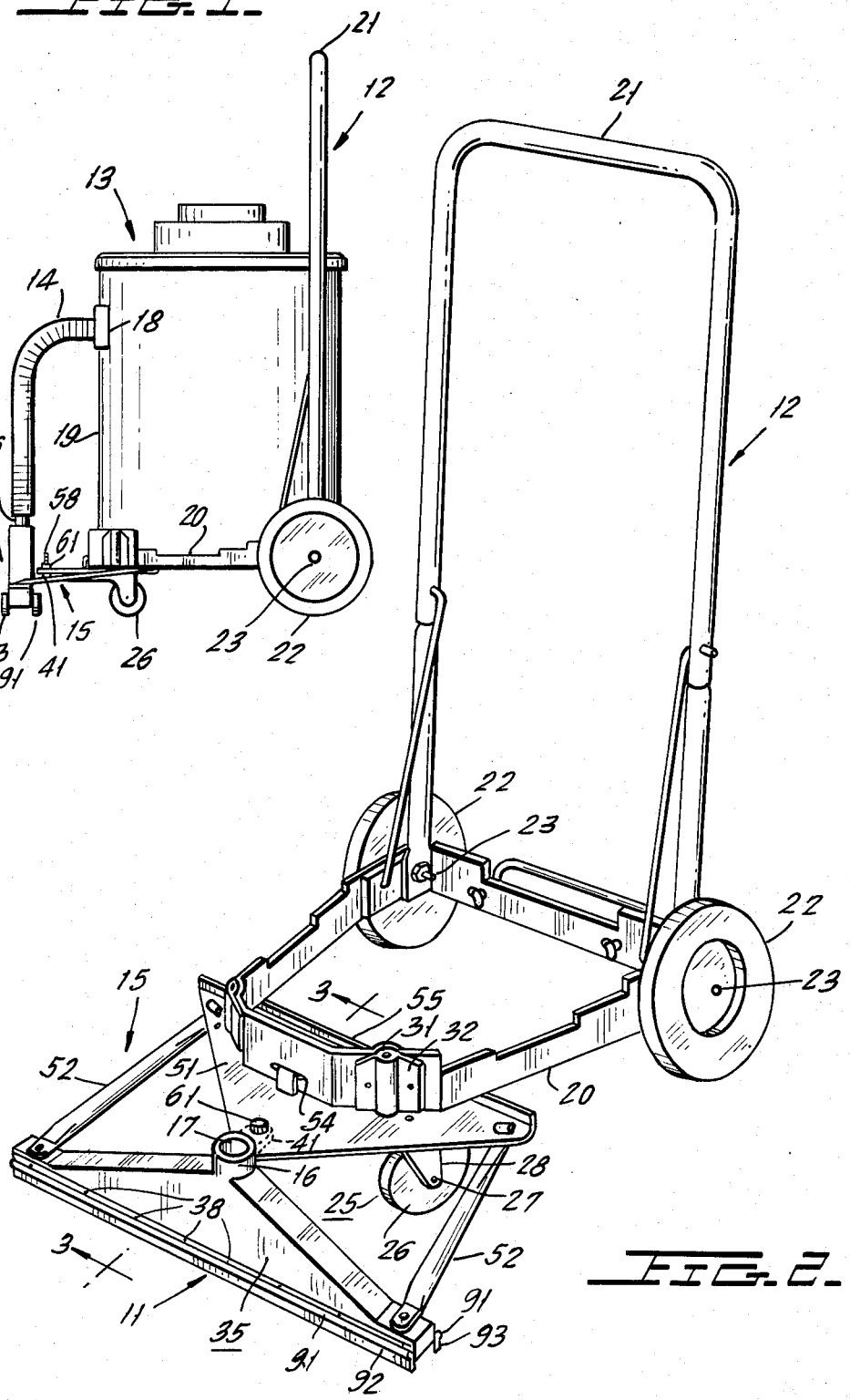
FIG. 1 is a side elevation of mounting means constructed in accordance with the instant invention in combination with a vacuum cleaner, dolly and floor nozzle.
FIG. 2 is a perspective of the dolly, floor nozzle unit and mounting means of FIG. 1.

Now referring to the drawings in which FIG. 1 is a general illustration of a tank-type vacuum cleaner 13 mounted on dolly 12 having floor nozzle unit 11 secured to the front thereof by mounting means 15 constructed in accordance with the instant invention. Flexible conduit 14 extends from neck 16, which defines outlet 17 of nozzle unit 11, to fitting 18 which defines a side inlet opening to dirt accumulating tank 19 of vacuum cleaner 13. The latter is of a type described in the aforesaid U.S. Pat. No. 4,435,877.

Dolly 12 is described in detail in the aforesaid co-pending application, Ser. No. 703,088. Briefly, dolly 12 includes horizontal framelike base 20 having inverted U-shaped handle 21 extending upward from the rear of base 20. A pair of relatively large wheels 22, 22 are mounted at the rear of base 20 on fixed axially aligned horizontal axles 23. The front of base 20 is supported by a pair of swivel-type wheel units 25, each including wheel 26 rotatable on axle 27 that extends between the spaced arms of inverted U-shaped support 28 having vertical swivel shaft or stem 29 extending upward therefrom. In a manner well known to the art, shaft 29 extends into wheel well 31 through the bottom thereof and is frictionally held therein. Wheel well 31 is formed by sheet metal element 32 secured to base 20 at the front thereof.

Figure 3:
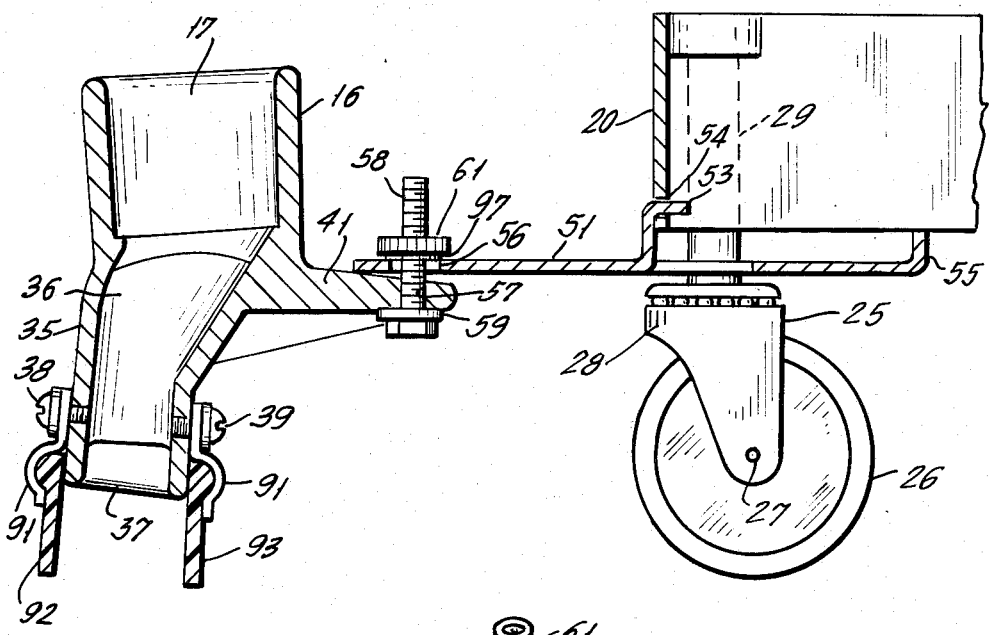
FIG. 3 is a fragmentary cross-section taken through line 3—3 of FIG. 2 looking in the direction of arrows 3—3.
Figure 4:
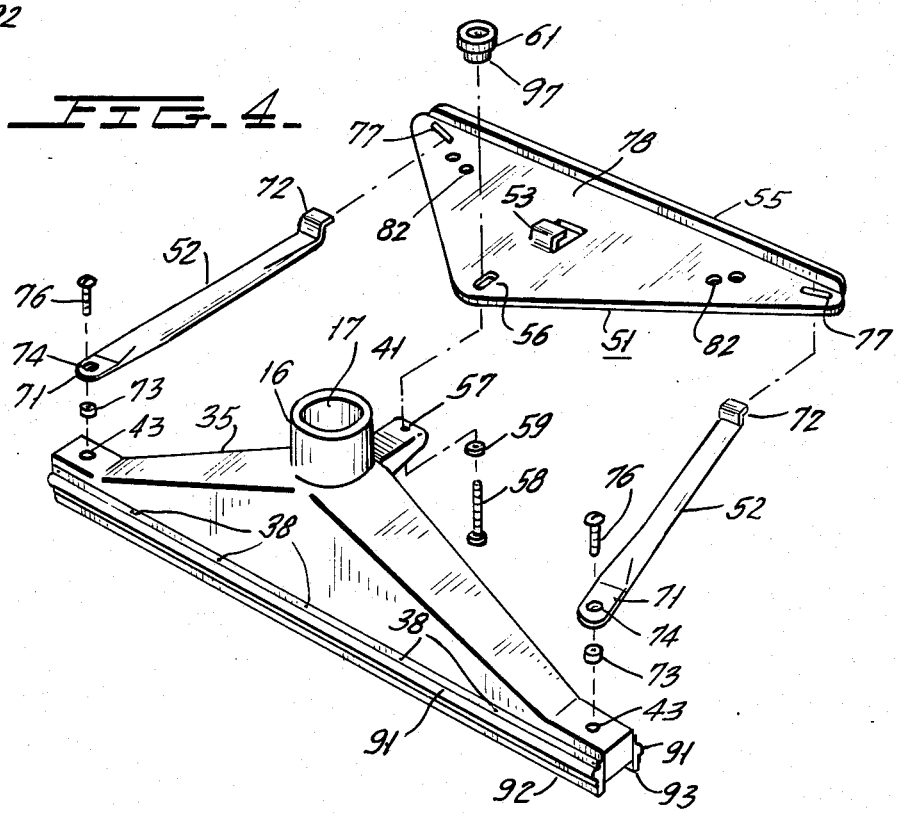
FIG. 4 is an exploded perspective of the mounting means and floor nozzle unit.
Figure 5:
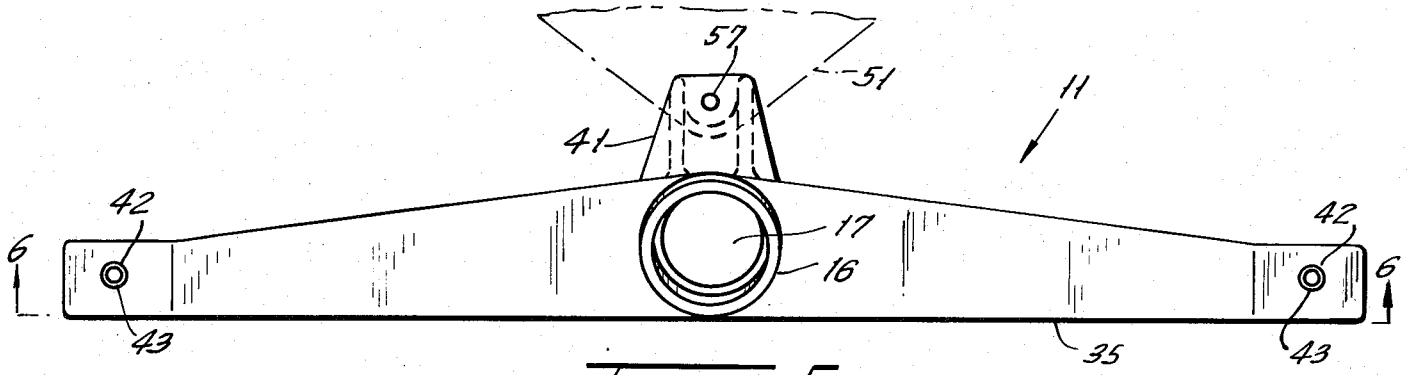
FIG. 5 is a plan view of the floor nozzle unit.
Figure 6:
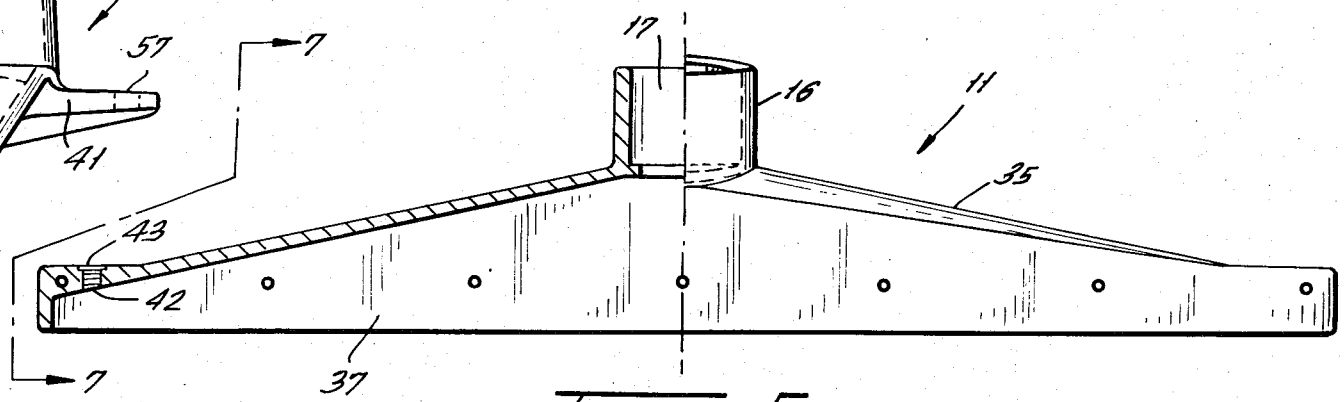
FIG. 6 is a front elevation of the floor nozzle unit looking in the direction of arrows 6—6 of FIG. 5.
Figure 7:
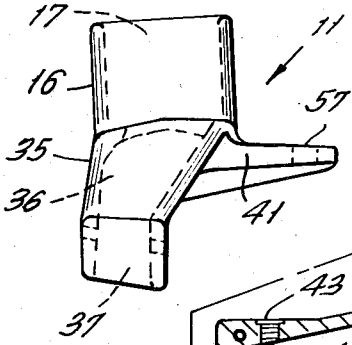
FIG. 7 is a side elevation of the floor nozzle unit looking in the direction of arrows 7—7 of FIG. 6.

Floor nozzle unit 11 includes horizontally elongated shoe 35 having neck 16 extending upwardly at the center thereof. Shoe 35 is a hollow member defining chamber 36 that a communicates with outlet 17. Inlet 37 to chamber 36 is a narrow slot disposed at the bottom of shoe 35 and extending the length thereof. A plurality of screws 38 secure individual clamping strips 91 to shoe 35 with these strips 91 securing flexible scraper strips 92, 93 at the front and rear, respectively, of inlet 37 (FIG. 3). For a reason to be hereinafter seen, shoe 35 is provided with horizontal rear extension 41 that is centered with respect to the length of shoe 35, and the upper surface of shoe 35 at the ends thereof is provided with threaded apertures 42 having enlarged recesses 43 at their upper ends.

Mounting means 15 includes triangular plate 51 and a pair of tubular struts 52. Disposed generally at the center of plate 51 and formed integrally therewith is rearwardly extending and upwardly offset ear 53 that is received by horizontal slot 54 at the front of base 20.

The insertion of ear 53 into slot 54 positions clearance apertures 82 of plate 51 below and in alignment with wells 31 so that shafts 29 pass through apertures 82 before entering wells 31. Thus, wheel units 25 provide two connecting points between plate 51 and base 20, and ear 53 provides a third connecting point between these members. The latter absorbs downwardly directed forces so that they will not be effective to withdraw shafts 29 from wells 31.

Upwardly turned lip 55 extending along the rear of plate 51 engages base 20 from below. Slightly elongated aperture 56 disposed at the front of plate 51 is positioned above aperture 57 in rearward extension 41 of nozzle shoe 35. Screw 58 extends upward through washer 59 disposed below nozzle extension 41, through aperture 57 in extension, and is received by the threaded aperture that extends through finger-operated nut 61. Downward extension 97 of nut 61 extends into plate aperture 56. Rotation of nut 61 is operable to adjust the height of floor nozzle unit 11.

Strut 52 is a tubular member whose respective front and rear ends 71, 72 are flattened. Nipple 73 is disposed within clearance aperture 74 that extends through front end 71. The bottom end of nipple 73 is disposed within recess 43. Screw 76 extends downward through nipple 73 and is threadably received in aperture 42 with the head of screw 76 blocking separation of strut end 71 from its pivotal engagement with nipple 73.

Rear end 72 of strut 52 is upwardly offset and is entered through the bottom of slot 77 in plate 51 near one end of lip 55 so that strut end 72 extends above main surface 78 of plate 51. The cooperation between strut end 72 and slot 77 provides a pivotal connection between plate 51 and strut 52. The spacing between slots 77 is not as great as the spacing between apertures 42 so that struts 52 diverge in a forward direction.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. Mobile vacuum cleaner apparatus including:

a vacuum cleaner, a dolly supporting said cleaner, a floor nozzle unit, mounting means securing said nozzle unit to said dolly in operative position at the front thereof, and conduit means operatively connecting an outlet of said nozzle unit to an inlet of said cleaner;

said dolly including a horizontal base having well means at the front thereof, floor engaging swivel-type wheel means having a vertical axis portion removably held in said well means, handle means extending from said base at the rear thereof, and floor engaging additional wheel means connected to said base at the rear thereof;

said nozzle unit including an elongated slot-like inlet facing the floor, said outlet being relatively small compared to said slot-like inlet; and said mounting means including a plate extending forward of said base and including aperture means through which said vertical axis portion extends before entering said well means.

2. Mobile vacuum cleaner apparatus as set forth in claim 1 in which the nozzle unit includes an elongated bottom main section that is provided with a short rearward extension at the center thereof secured directly to said plate;

said mounting means including first and second struts extending rearward from opposite ends of said main section to said plate.

3. Mobile vacuum cleaner apparatus as set forth in claim 2 in which the struts diverge as they extend forward from said plate.

4. Mobile vacuum cleaner apparatus as set forth in claim 2 in which the plate is provided with an upwardly offset ear that is disposed within an aperture of said base at the front thereof, said aperture being disposed midway between horizontally spaced first and second wheel wells that constitute said well means.

5. Mobile vacuum cleaner apparatus as set forth in claim 4 in which the ear extends rearward and enters the aperture from in front of the base.

6. Mobile vacuum cleaner apparatus as set forth in claim 5 in which the struts diverge as they extend forward from said plate.

7. Mobile vacuum cleaner apparatus as set forth in claim 6 also including adjustable fastening means securing said rearward extension to said plate for adjusting vertical spacing between the latter and said rearward extension.

8. Mobile vacuum cleaner apparatus as set forth in claim 7 in which each of said struts is provided with a flattened end that is received by a complementary slot in said plate to form generally horizontally pivot connections between said plate and said struts.

9. Mobile vacuum cleaner apparatus as set forth in claim 8 in which said flattened ends are forwardly offset and enter said slots from below said plate.

10. Mobile vacuum cleaner apparatus as set forth in claim 9 in which the plate is provided with an upturned edge at the rear thereof, said upturned edge engaging the bottom of the base.

11. Mobile vacuum cleaner apparatus as set forth in claim 2 also including adjustable fastening means securing said rearward extension to said plate for adjusting vertical spacing between the latter and said rearward extension.

12. Mobile vacuum cleaner apparatus as set forth in claim 11 in which each of said struts is provided with a flattened end that is received by a complementary slot in said plate to form generally horizontally pivot connections between said plate and said struts.

13. Mobile vacuum cleaner apparatus as set forth in claim 12 in which said flattened ends are forwardly offset and enter said slots from below said plate.

14. Mobile vacuum cleaner apparatus as set forth in claim 2 in which there are generally horizontal pivot connections between the struts and the plate, and generally vertical pivot connections between the struts and the main section of said nozzle unit.

15. Mobile vacuum cleaner apparatus as set forth in claim 1 in which the plate is provided with an upwardly offset ear that is disposed within an aperture of said base at the front thereof, said aperture being disposed midway between horizontally spaced first and second wheel wells that constitute said well means.

16. Mobile vacuum cleaner apparatus as set forth in claim 15 which the ear extends rearward and enters the aperture from in front of the base.

17. Mobile vacuum cleaner apparatus as set forth in claim 1 in which the plate is provided with an upturned edge at the rear thereof, said upturned edge engaging the bottom of the base.

18. Mobile vacuum cleaner apparatus including:

a vacuum cleaner, a dolly supporting said cleaner, a floor nozzle unit, mounting means securing said nozzle unit to said dolly in operative position at the front thereof, and conduit means operatively connecting an outlet of said nozzle unit to an inlet of said cleaner;

said mounting means including a plurality of frictionally held stems that extend perpendicular to the direction of forces which, under normal usage of the apparatus, are transferred from the floor nozzle unit to the dolly.

19. Mobile vacuum dolly apparatus as set forth in claim 18 in which all forces from raising the floor nozzle unit are transferred to the dolly without placing loads on the frictionally held stems.

20. Mobile vacuum cleaner apparatus as set forth in claim 18 in which each of the frictionally held stems constitutes part of a caster wheel assembly which partially supports the dolly.

* * * * *